US005579657A

United States Patent [19]

Makous

[11] Patent Number: 5,579,657

[45] Date of Patent: Dec. 3, 1996

[54] ANTI-THEFT DEVICE FOR SMALL PORTABLE EQUIPMENT AND METHOD

[76] Inventor: Joseph Makous, 119 Montrose Ave., Rosemont, Pa. 19010

[21] Appl. No.: 518,988

[22] Filed: Aug. 24, 1995

[51] Int. Cl.[6] ..... E05B 73/00

[52] U.S. Cl. ..... 70/15; 70/18; 70/58; 248/51; 248/551

[58] Field of Search ..... 70/14, 15, 18, 70/DIG. 57, 57, 58, 57.1, 30, 49; 439/133, 501; 248/51, 551, 552; 345/163–167; 361/683, 686

[56] References Cited

U.S. PATENT DOCUMENTS

| | | | |
|---|---|---|---|
| 4,123,922 | 11/1978 | Kuenstler | 70/58 |
| 4,212,175 | 7/1980 | Zakow | 70/58 |
| 4,362,288 | 12/1982 | Allen | 248/51 X |
| 4,570,465 | 2/1986 | Bennett | 70/18 |
| 4,676,080 | 6/1987 | Schwarz | 70/58 X |
| 4,738,428 | 4/1988 | Themistos et al. | 70/58 X |
| 4,959,635 | 9/1990 | Wilson | 70/58 X |
| 5,050,836 | 9/1991 | Makous | 248/553 |
| 5,351,507 | 10/1994 | Derman | 70/58 |
| 5,398,530 | 3/1995 | Derman | 70/58 |
| 5,502,989 | 4/1996 | Murray, Jr. et al. | 70/14 X |

OTHER PUBLICATIONS

Secure–It, Inc., Specification Sheet, p. 15, 1995 catalog, Part No. MST–580 entitled "Mouse–Trap".

QUALTEC, Product Profile, p. 1, 1994 catalog, Part No. 02002, entitled "Cable–Trap".

*Primary Examiner*—Lloyd A. Gall

*Attorney, Agent, or Firm*—David N. Makous; John S. Christopher

[57] ABSTRACT

An anti-theft device for small portable equipment and method includes at least one conductor extending therefrom having a first end permanently connected to the equipment and a second end formed into a plug for fitting into a receptacle. The anti-theft device comprises a planar disk having a penetration formed therethrough which is large enough to enable the passage of a loop of the equipment conductor but small enough to prevent the passage of the plug. A security cable passes through the loop of equipment conductor extending through the penetration of the planar disk. The security cable is securely anchored to prevent the removal of the loop of equipment conductor from the penetration of the planar disk which prevents the removal of the small portable equipment. The planar disk can be positioned to any location along the equipment conductor and along the security cable. In a preferred embodiment, the planar disk exhibits a flat, elongated shape and the penetration formed therethrough is oval shaped. The loop is then formed in the equipment conductor and is threaded through the oval shaped penetration in the planar disk. Finally, the security cable is passed through the loop of equipment conductor extending through the penetration. The security cable is securely anchored by a known attachment method to prevent the removal of the loop of equipment conductor from the penetration formed in the flat planar disk. The penetration formed in the planar disk may also be circular.

9 Claims, 3 Drawing Sheets

FIG. 1
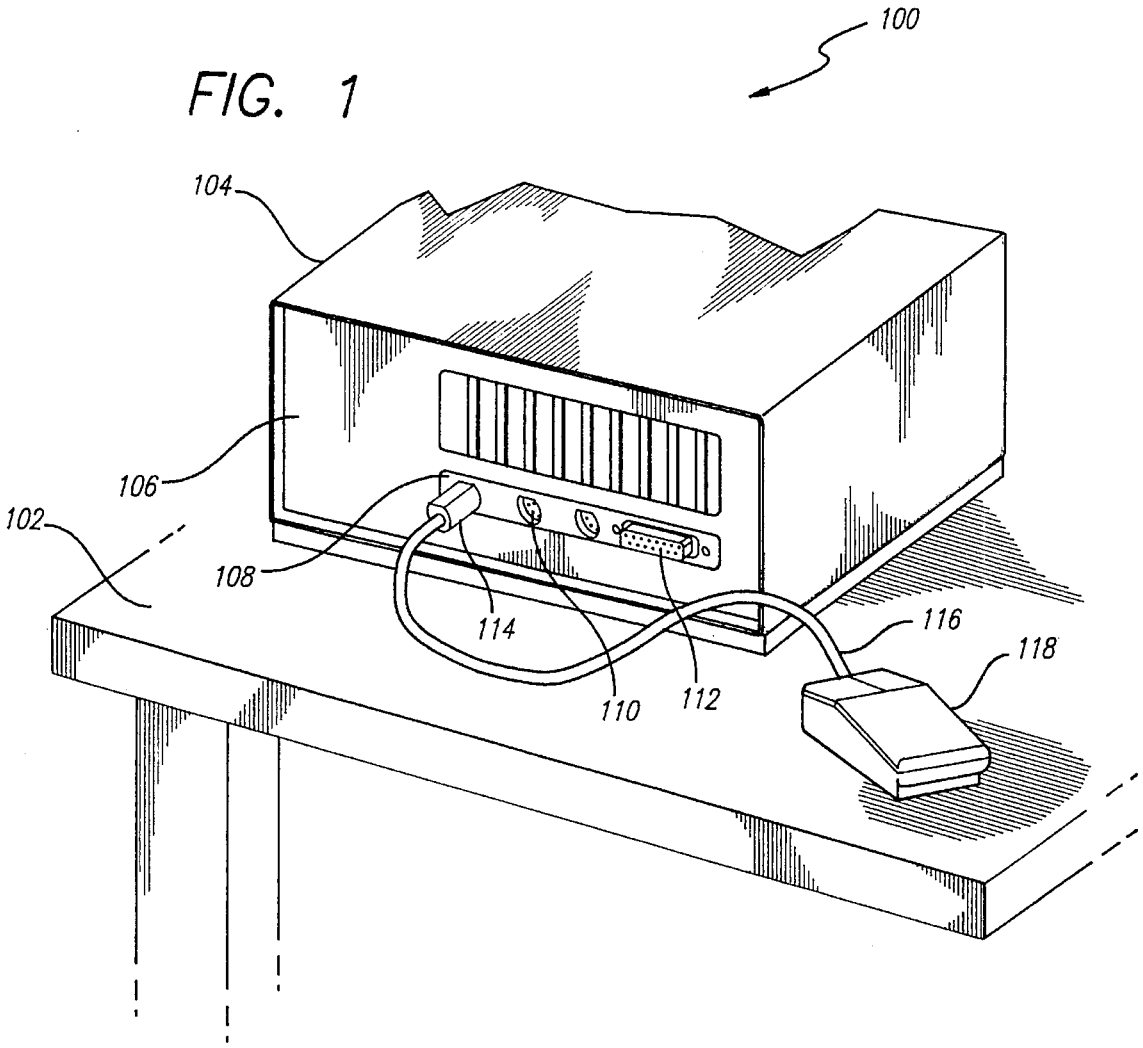
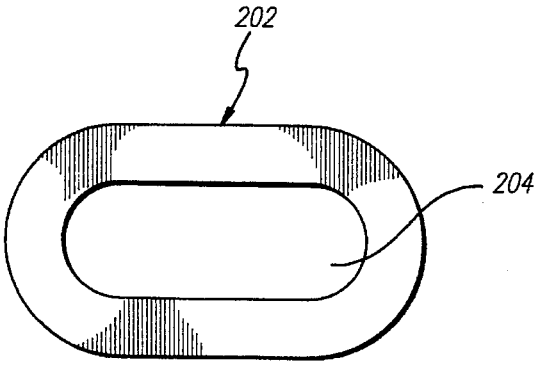
FIG. 4

ANTI-THEFT DEVICE FOR SMALL PORTABLE EQUIPMENT AND METHOD

BACKGROUND OF THE INVENTION

1. Field of the Invention:

The present invention generally relates to anti-theft devices for small portable equipment, and more particularly relates to a cable attachment device which may be used in combination with an anti-theft cable system for securing small portable equipment to an anti-theft cable.

2. Description of the Related Art:

Portable desktop computer equipment has become increasingly powerful and thus the monetary value and importance of this equipment to businesses and institutions using them has also increased. Likewise, the broad array of small computer peripheral devices employed with portable desktop computer equipment, such as a keyboard or a trackball mouse, has also increased in monetary value and importance. Furthermore, other small portable equipment such as credit card terminals and calculators have also found significant uses in businesses and institutions.

Protecting computers and other office machines from theft usually requires securing the computer or machine to an immovable object. Various types of anti-theft systems for tying down and connecting portable equipment with heavy duty security cables have been developed. Such cable security systems typically include a steel cable and various attachment hardware to anchor the portable equipment to a work station which is relatively stationary. Typically, a cable attachment fixture is mounted to a portion of the surface of the equipment and to the surface of a work station by screw mounted fittings and/or adhesive plates. Screw mounted fittings such as an attachment ring or a shaft with a hole formed therethrough are typically attached to the equipment by using existing equipment screws. The security cable system is then attached to the screw mounted fittings on the equipment.

Such a security system for office equipment is disclosed in U.S. Pat. No. 5,050,836 (hereinafter the U.S. Pat. No. '836 patent) issued to Applicant on Sep. 24, 1991 and entitled Security Device For Portable Equipment. The U.S. Pat. No. '836 patent discloses a rigid base plate and a resilient elastomeric base pad permanently secured to the base plate for providing a flexible but strong adhesive bond to the surface of the portable equipment or other anchor fixture. A rotatable attachment fitting is connected to the base plate and includes a rotatable shaft having a means for receiving a security cable such as a transverse aperture formed through the rotatable shaft. A means is also provided for securing the security cable to the rotatable shaft such as by a set screw in the rotatable shaft.

Systems for securing computers and office machines known in the art as described hereinabove are suitable for use if two conditions are satisfied. The first condition requires that the equipment to be secured must be (a) large enough to accept hardware, such as an adhesive plate, which is used for the attachment of the steel cable or (b) large enough to enable direct attachment of the steel cable though the equipment chassis. The second condition requires that the equipment to be secured remain relatively static during usage. Equipment such as computers, monitors, facsimile machines, printers, photocopy machines, laboratory equipment and cash registers each satisfy these requirements and thus the security systems known in the prior art are well suited and can be employed.

However, other devices such as a computer keyboard, a trackball mouse, a hand scanner, a credit card terminal or a non-battery powered calculator do not meet the conditions set forth above. In particular, these small portable devices are not large enough to accept an adhesive plate or a screw mounted fitting used for the attachment of a steel cable or to accommodate direct attachment of the steel cable. Further, many small portable devices are not relatively static during usage. With the emphasis on miniaturizing hardware, both the keyboard and the mouse are often too small to facilitate the attachment of a security cable. Additionally, the mouse must be free to move during operation and thus cannot be secured to a single location by a security cable. Furthermore, a credit card terminal and a non-battery powered calculator provide examples of equipment that often are moved about in the office environment. Therefore, security systems known in the art for securing larger, non-mobile office equipment do not satisfy the security requirements of small portable devices found in the office environment.

Typically, small portable equipment is not securely fastened to any non-mobile structure to prevent theft. For example, a computer keyboard or computer mouse is connected to an associated microprocessor via a multi-conductor cable. One end of the multi-conductor cable is securely fastened to the keyboard or mouse while the other end of the multi-conductor cable merely plugs into a terminal socket or receptacle on the rear side of the microprocessor. Typically, a credit card terminal is connected to a data/telephone line and a power line where one end of the data/telephone line and power line are each securely connected to the terminal. The other end of the two lines are merely plugged into telephone and power outlets. Another example is a calculator energized by 60 Hz power via a power cord. One end of the power cord may be securely fastened to the calculator chassis (via a stepdown transformer) but the other end is merely plugged into an electrical wall outlet. In each of these cases, the small portable equipment is unfortunately subject to theft.

Anti-theft devices for use with small portable equipment are known in the art. In particular, two prior art devices known to Applicant will now be described. The first prior art device comprises a glue-on disc fastener having a mouse cable clip. The glue-on disc fastener can be, for example, a rigid steel plate mounted to a cable attachment pad positioned on the side of a computer. The rigid plate cooperates with a steel fastener having a penetration through which a security cable passes. The mouse cable clip is secured to the rigid steel plate with a screw hidden behind the security cable. The mouse cable is secured within the cable clip since the plug integrally formed on the end of the mouse cable will not pass through the cable clip. The cable clip also allows for full extension of the mouse cable. However, a problem exists in that the mouse cable must be adjacent to the cable attachment pad which secures the rigid plate. In some computers, air vents are formed on the right side of the computer housing and thus the cable attachment pad (and the rigid plate and mouse cable clip) must be mounted on the left side of the computer. This condition is awkward for a right-handed user because of the limited length of the mouse cable.

The second prior art device comprises an apparatus for trapping the peripheral cable of, for example, a mouse, hand scanner, trackball or keyboard. The second device is comprised of a box having a keyed removable cover. The sides of the box are fashioned to include a pair of elongated grooves suitable for sliding a plurality of peripheral cables therethrough. The box is attached to the surface of the computer housing by utilizing an external cover screw or by bonding. The peripheral cables are positioned within the elongated grooves such that the cables pass through the box. Once the keyed removable cover is locked into position, the cables are trapped since the plug integrally formed at the end of the cable is too large to pass through the elongated grooves. The problem associated with the second prior art device is that with the trend toward miniaturization and increasing the number of computer features, available space of the backside of the computer housing is limited. With limited space to choose from, the box is likely to be mounted to the side of the computer housing. Mounting the box to the side of the computer housing is likely to interfere with placement of other equipment in situations involving limited equipment space.

Thus, there is a need in the art for an improvement in anti-theft devices for small portable equipment utilized in an office environment and particularly with computer peripheral devices in which the anti-theft device does not require any mounting space on the computer housing, cooperates with existing equipment security systems, can be adapted to any existing portable desktop computer system and is simple and inexpensive to manufacture and install.

SUMMARY OF THE INVENTION

Briefly, and in general terms, the present invention provides a new and improved anti-theft device for small portable equipment and method therefore embodying a novel apparatus for securing the conductor extending from a small portable device to an anchored security cable by utilizing a flat planar disk with a penetration formed therein.

The present invention is generally directed to an improved anti-theft device for small portable equipment and method therefore and is typically employed in a computer or office environment where small portable equipment is subject to theft. The small portable equipment includes at least one conductor extending therefrom having a first end permanently connected to the equipment and a second end formed into a plug for fitting into a receptacle. The anti-theft device comprises a planar disk having a penetration formed therethrough. The penetration is large enough to enable the passage of a loop of the equipment conductor and small enough to prevent the passage of the plug. A security cable passes through the loop of equipment conductor extending through the penetration of the planar disk. The security cable is securely anchored to prevent the removal of the loop of equipment conductor from the penetration of the planar disk which prevents the removal of the small portable equipment. The planar disk can be conveniently positioned to any location along the equipment conductor and along the security cable.

Small portable equipment found in the office environment is often not large enough to accept an adhesive plate or a screw mounted fitting used for the attachment of a steel cable or to accommodate direct attachment of the steel cable. Further, many small portable devices are not static during usage and thus the securing systems for computers and offices machines are not suitable. Typically, small portable equipment is not securely fastened to any non-mobile structure to prevent theft. Fortunately, the present invention addresses this problem by providing an anti-theft device for use with small portable equipment.

In a preferred embodiment, a planar disk having a flat, elongated shape is provided. An oval penetration is formed through the planar disk which is large enough to enable the passage of a loop of the equipment conductor but small enough to prevent the passage of the plug. A loop is then formed in the equipment conductor and is threaded through the penetration in the planar disk. Finally, a security cable is passed through the loop of equipment conductor extending through the penetration. The position of the planar disk can be adjusted to any location along the equipment conductor and along the security cable. The security cable is securely anchored to prevent the removal of the loop of equipment conductor from the penetration formed in the flat planar disk. As a result, the unauthorized removal of the equipment is prevented. The penetration formed in the planar disk may also be circular and have a diameter sufficient to eliminate excess stress on the loop of equipment conductor passing therethrough.

These and other objects and advantages of the present invention will become apparent from the following more detailed description, taken in conjunction with the accompanying drawings which illustrate the invention, by way of example.

BRIEF DESCRIPTION OF THE DRAWINGS

FIG. 1 is a fragmented perspective view showing the rear side of a known desktop computer system showing a computer mouse and conductor connected to a terminal receptacle via a plug mounted on the end of the mouse conductor.

FIG. 4 is a front elevational view of the anti-theft device shown in FIGS. 2 and 3 illustrating the elongated oval shape of the preferred embodiment.

DESCRIPTION OF THE PREFERRED EMBODIMENT

Figure 2:
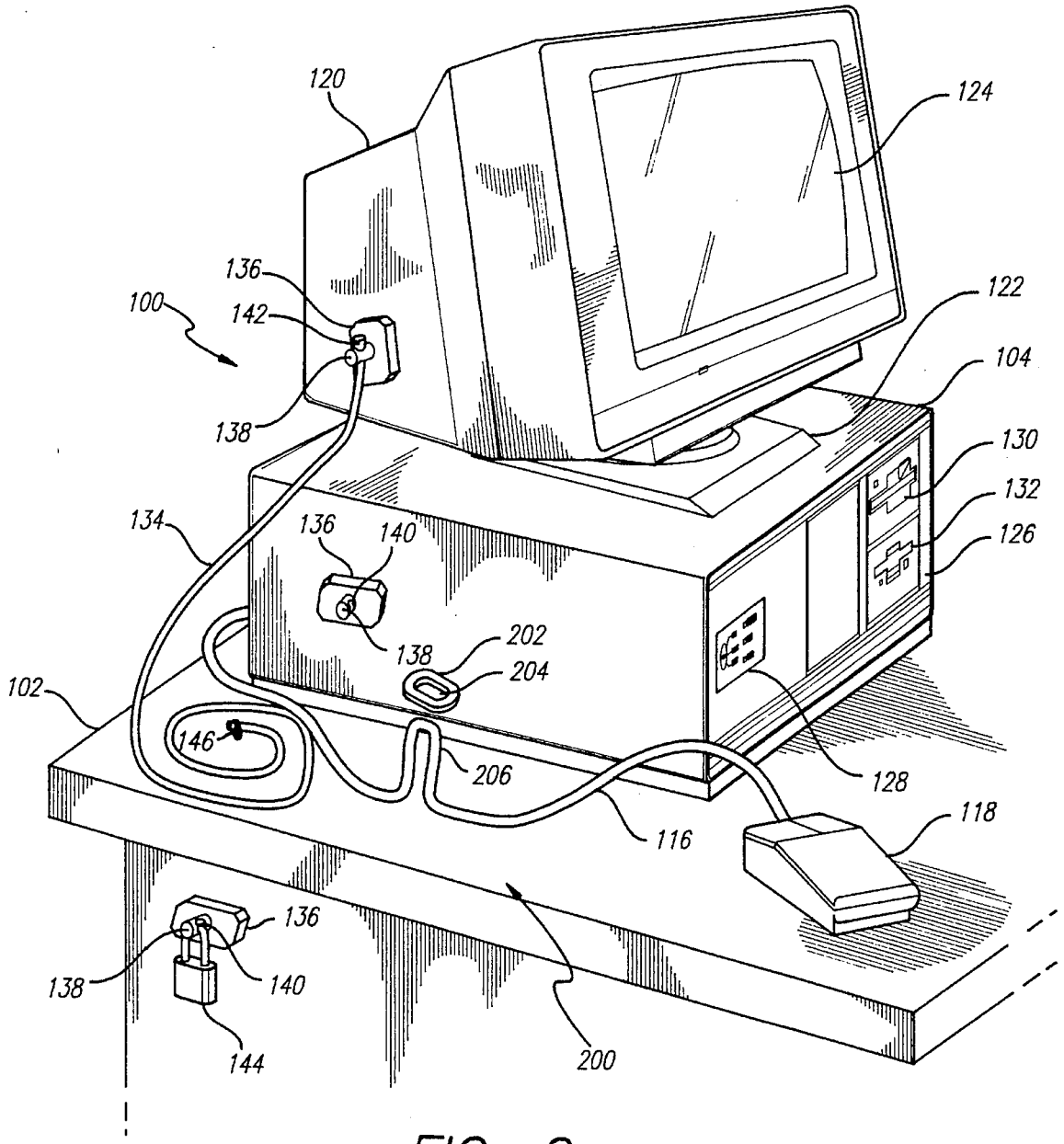
FIG. 2 is a perspective view of a desktop computer system fitted with a security cable and of the anti-theft device of the present invention for small portable equipment showing the orientation of the anti-theft device with respect to a computer mouse conductor.

Referring now to the drawings, and particularly to FIG. 1, there is shown a fragmented rear view of a desktop computer system 100 as is known in the art. The computer system 100, as shown positioned upon a desk or table 102, includes a computer enclosure or housing 104. The computer housing 104 includes a rear panel 106 having a terminal block 108 mounted therein. The terminal block 108 includes a plurality of receptacles 110 and terminal pads 112 utilized to facilitate the electrical interconnection of the various components of the computer system 100.

Mounted within one of the plurality of receptacles 110 in the terminal block 108 is a connection plug 114 as shown in FIG. 1. The connection plug 114 is attached to and in signal communication with an electrical conductor 116. Likewise, the electrical conductor 116 is connected to and in signal communication with a computer mouse 118. The electrical conductor 116 includes a plurality of electrical wires (not shown) to enable communication between the computer mouse 118 and the computer system 100 via the receptacles 110 on the terminal block 108.

The computer mouse 118 represents an example of a class of small portable equipment employed in computer and office environments. Typically, the electrical conductor 116 is securely fastened to the small portable equipment, such as the computer mouse 118. However, the electrical conductor 116 is merely inserted into the receptacle 110 on the terminal block 108 via the connection plug 114 and thus, is easily removed. Thus, the manner of connecting the small portable equipment, e.g., the computer mouse 118 shown in FIG. 1, to the computer system 100 provides an easy target for theft. Additional examples of small portable equipment connected in a similar manner and subject to theft include a computer keyboard, a hand scanner, a security card terminal and a non-battery operated calculator (not shown).

The desktop computer system 100 is also shown in FIG. 2 and further illustrates a viewing monitor 120 mounted upon a monitor base 122. The monitor base 122 is seated upon the computer housing 104. The monitor 120 includes a viewing screen 124 which is oriented with a front panel 126 of the computer housing 104 as shown in FIG. 2. The front panel 126 comprises a control section 128, including for example an On-Off switch, and a pair of first and second entry ports 130 and 132, respectively, for accessing the disk drives (not shown) of the computer system 100. The computer mouse 118 is also shown connected to the electrical conductor 116 which is shown circuited to the computer rear panel 106.

Figure 3:
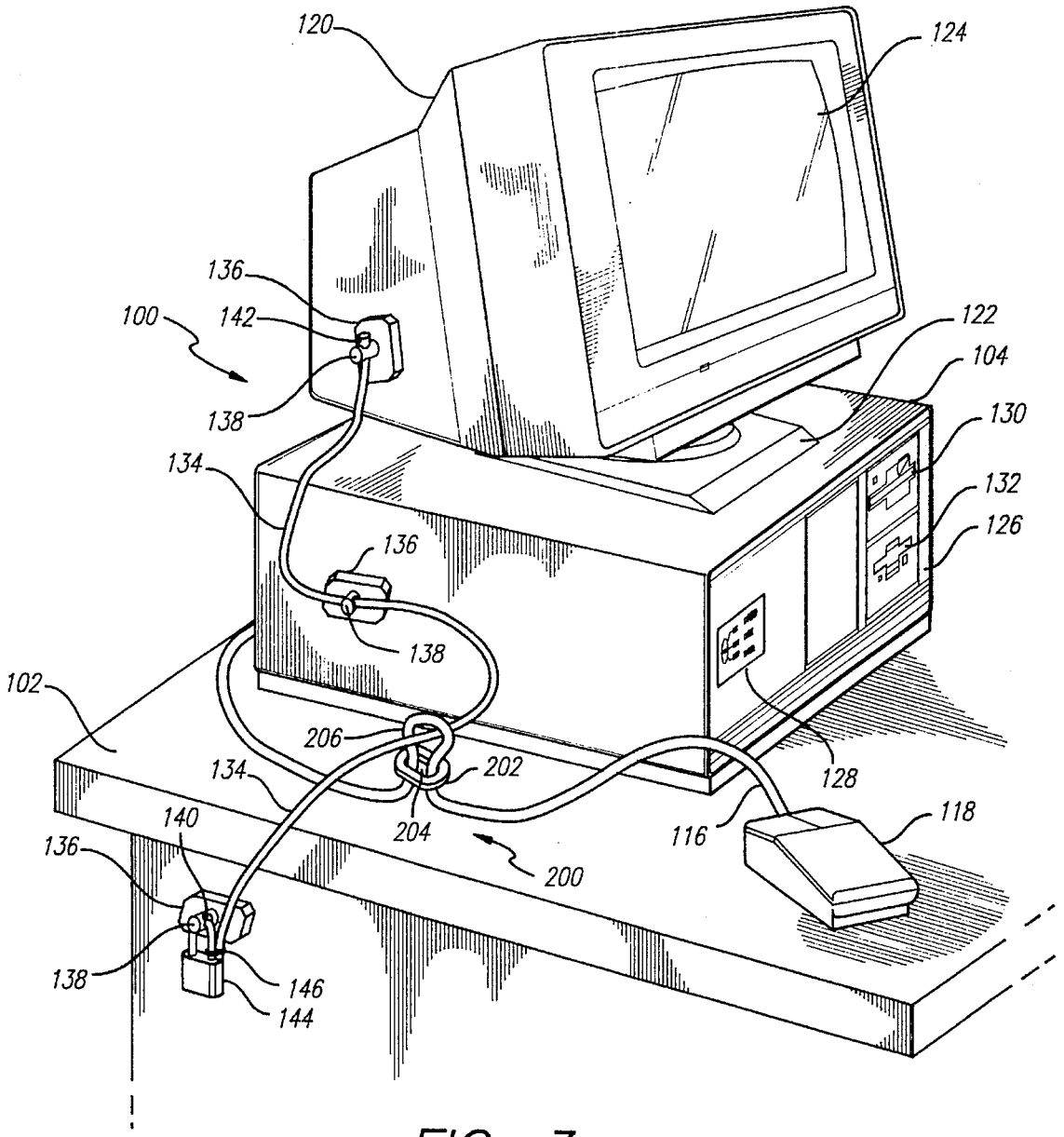
FIG. 3 is a perspective view of the desktop computer system and the anti-theft device of FIG. 2 illustrating the cooperation between the anti-theft device and the security cable employed to protect the desktop computer system.

As shown in FIGS. 2 and 3, a security cable 134 is utilized to secure the computer housing 104 to the viewing monitor 120 and the computer table 102. The means to attach the security cable 134 to the computer housing 104, the monitor 120 and the computer table 102 can vary. FIGS. 2 and 3 illustrate, by way of example only, the use of a known cable attachment device comprising a rigid base plate 136 and a rotatable shaft 138 having a transverse aperture 140 formed therethrough. Rigid base plates 136 can be secured to each of the monitor 120, housing 104 and table 102 either by mechanical or adhesive means. The security cable 134 is passed through the aperture 140 of each rotatable shaft 138 and is secured to shaft 138 at the monitor 120 by a mechanical stop 142 and at the table 102 by attachment to a padlock 144 and connection ring 146 as is known in the art. Thus, the security cable 134, once attached, is securely anchored.

The anti-theft device for small portable equipment 200 of the present invention is shown in FIGS. 2 and 3. The anti-theft device 200 comprises a planar disk 202 which exhibits a flat, elongated shape as is best shown in FIG. 4. The flat planar disk 202 is constructed of steel or, in the alternative, plastic of sufficient strength to resist breaking or cutting. A penetration 204 is formed in the flat planar disk 202 which, in the preferred embodiment, is oval shaped. The oval shaped penetration 204 provides sufficient space to help eliminate excess stress applied to the electrical conductors 116 which are passed through the penetration 204 as is described hereinbelow. It is noted that the oval shaped penetration 204 formed in the flat planar disk 202 includes sufficient space to accommodate multiple electrical conductors 116 from multiple small portable office devices.

In the alternative, the shape of the flat planar disk 202 and the penetration 204 formed therein can be circular if the penetration 204 is large enough to eliminate excess stress applied to the electrical conductors 116 which are passed therethrough. Notwithstanding an oval shaped or circular shaped penetration 204 sized to accommodate multiple electrical conductors 116, the penetration 204 must not be large enough to pass the larger diameter connection plug 114 integrally formed on the end of each electrical conductor 116 as shown in FIG. 1. The inability of the connection plug 114 to pass through the penetration 204 of the flat planar disk 202 is what prevents the unauthorized removal of the computer mouse 118 once the anti-theft device 200 is secured in position.

Installation of the anti-theft device 200 for securing small portable equipment such as the computer mouse 118 is as follows. The electrical conductor 116 extending from the computer mouse 118 is pinched to form a loop 206 as is best shown in FIG. 2. The loop 206 of electrical conductor 116 is then aligned with and threaded through the oval shaped penetration 204. The end of the security cable 134 having the connection ring 146 attached thereto is then threaded through the space bounded by the loop 206 of electrical conductor 116 (extending through the penetration 204) and the flat planar disk 202. The connection ring 146 is then fastened to the padlock 144 which penetrates the transverse aperture 140 of the rotatable shaft 138 on the computer table 102. The installation of the anti-theft device 200 is now complete as is clearly illustrated in FIG. 3 and the computer mouse 118 or other small portable equipment is securely attached to the security cable 134.

An advantage of the anti-theft device 200 of the present invention is that the position of the flat planar disk 202 can be adjusted to any location along the electrical conductor 116 and also along the security cable 134. This is accomplished merely by drawing or withdrawing appropriate lengths of the electrical conductor 116 and the security cable 134 through the flat planar disk 202 as is clearly shown in FIG. 3.

Removal of the anti-theft device 200 is accomplished by reversing the procedure for installation. In particular, the padlock 144 would be unlocked and removed so as to release the connection ring 146 at the end of the security cable 134. The end of the security cable 134 would then be threaded back through the loop 206 of electrical conductor 116. With the security cable 134 removed, the loop 206 of electrical conductor 116 can be withdrawn from the penetration 204 formed within the flat planar disk 202. Thereafter, the connection plug 114 formed on the end of the electrical conductor 116 can be removed from the receptacle 110 at the terminal block 108 on the rear panel 106 of the computer housing 104.

It is noted that the security cable 134 is preferably a flexible steel cable similar to that used in other commercial products, for example, bicycle locks. However, other means to secure the anti-theft device 200 of the present invention can be satisfactory employed. For example, it is foreseeable that a flexible cable comprised of material other than steel or a non-flexible steel cable could be successfully utilized. In the case of a non-flexible cable comprised of steel or other material, the connection plug 114 might have to be disconnected from the receptacle 110. Then, the loop 206, which extends through the penetration 204, is positioned to thread the end of the non-flexible cable through the loop 206. Thereafter, the plug 114 is repositioned and reconnected to the receptacle 110. It is also foreseeable that a separate loop of flexible cable (not shown) is threaded through the loop 206 of electrical conductor 116 shown in FIGS. 2 and 3 and then the separate loop secured to the computer table 102 or other immovable object.

It will be appreciated that the anti-theft device 200 of present invention provides a simple but effective means for securing small portable equipment from unauthorized removal. Although the larger diameter connection plug 114 will not pass through the penetration 204 of the flat planar disk 202, the electrical conductor 116 of the computer mouse 118 is easily drawn through the penetration 204. Since the position of the flat planar disk 202 can be adjusted to any location along the electrical conductor 116 and also along the security cable 134, the computer mouse 118 can be easily positioned. Thus, the computer mouse 118 retains mobility and additional electrical cable 116 can be drawn through the flat planar disk 202 as needed. Further, the problems associated with direct cable attachment to the computer mouse 118 are avoided. Unauthorized removal of the computer mouse 118 or other small portable equipment requires the severing of the electrical conductor 116 which renders the computer mouse 118 useless.

The present invention provides novel advantages over other anti-theft systems known in the art which are utilized with small portable equipment. In particular, the anti-theft device 200 of the present invention cooperates with prior art security devices utilized to secure large portable office equipment. Since the anti-theft device 200 cooperates with the security cable 134 or other means to prevent the removal of the computer mouse 118, valuable space on the computer housing 104 is not utilized or required. Further, the anti-theft device 200 of the present invention is small and can be located at any point along the security cable 134 and at any point along the mouse electrical conductor 116 which increases the convenience to the user. Additionally, the anti-theft device 200 is simple in construction, economical to manufacture and easy to install and can be adapted to any existing computer system 100 or similar equipment.

It will be apparent from the foregoing that, while particular forms of the invention have been illustrated and described, various modifications can be made without departing from the spirit and scope of the invention. Accordingly, it is not intended that the invention be limited, except as by the appended claims. Accordingly,

What is claimed is:

1. An anti-theft device and small portable equipment, said equipment including at least one conductor extending therefrom having a first end permanently connected to said equipment and a second end formed into a plug for fitting into a receptacle, said anti-theft device comprising:

a planar disk having a penetration formed therethrough, said penetration being large enough to enable the passage of a loop of said conductor but small enough to prevent the passage of said plug; and security means passing through said loop of conductor extending through said penetration, said security means being securely anchored for preventing the removal of said loop of conductor from said penetration and for preventing the removal of said equipment wherein said planar disk being positional to any location along said conductor and along said security means.

2. The anti-theft device and equipment of claim 1 wherein said planar disk comprises an elongated shape.

3. The anti-theft device and equipment of claim 1 wherein said planar disk is comprised of steel.

4. The anti-theft device and equipment of claim 1 wherein said planar disk is comprised of plastic.

5. The anti-theft device and equipment of claim 1 wherein said penetration formed through said planar disk is oval shaped.

6. The anti-theft device and equipment of claim 1 wherein said security means comprises a steel cable.

7. The anti-theft device and equipment of claim 1 wherein said security means comprises a flexible steel cable.

8. An anti-theft device and small portable equipment, said equipment including at least one conductor extending therefrom having a first end permanently connected to said equipment and a second end formed into a plug for fitting into a receptacle, said anti-theft device comprising:

a planar disk having a penetration formed therethrough, said penetration being large enough to enable the passage of a loop of said conductor but small enough to prevent the passage of said plug; and a security cable passing through said loop of conductor extending through said penetration, said security cable being securely anchored for preventing the removal of said loop of conductor from said penetration and for preventing the removal of said equipment wherein said planar disk being positional to any location along said conductor and along said security cable.

9. A method of securing small portable equipment with an anti-theft device, said equipment including at least one conductor extending therefrom having a first end permanently connected to said equipment and a second end formed into a plug for fitting into a receptacle, said method comprising the steps of:

providing a planar disk having a flat, elongated shape;

providing a penetration through said planar disk, said penetration being large enough to enable the passage of a loop of said equipment conductor but small enough to prevent the passage of said plug;

forming a loop in said conductor;

threading said loop of conductor through said penetration in said planar disk;

passing a security cable through said loop of conductor extending through said penetration; and adjusting the position of said planar disk to any location along said conductor and along said security cable, said security cable being securely anchored for preventing the removal of said loop of conductor from said penetration and for preventing the removal of said equipment.

* * * * *